United States Patent [19]

Rawlyk

[11] Patent Number: 5,020,758

[45] Date of Patent: Jun. 4, 1991

[54] SHELF BRACKET

[75] Inventor: Bert Rawlyk, Huntingdale, Australia

[73] Assignee: B. R. Products Pty. Limited, Huntingdale, Australia

[21] Appl. No.: 544,399

[22] Filed: Jun. 27, 1990

[30] Foreign Application Priority Data

Dec. 7, 1987 [AU] Australia ..... 27065/88

[51] Int. Cl.[5] ..... A47G 29/02

[52] U.S. Cl. ..... 248/250; 108/108; 108/152; 211/90

[58] Field of Search ..... 248/250, 235, 243; 211/90, 134, 186, 187; 108/108, 152, 107

[56] References Cited

U.S. PATENT DOCUMENTS

| | | | |
|---|---|---|---|
| 4,429,850 | 2/1984 | Weber | 108/108 X |
| 4,508,301 | 4/1985 | Nicholson | 248/250 |
| 4,691,887 | 9/1987 | Bessinger | 211/90 X |
| 4,736,918 | 4/1988 | Bessinger | 248/250 |
| 4,736,919 | 4/1988 | Bessinger | 211/90 X |
| 4,738,426 | 4/1988 | Bessinger | 108/152 X |
| 4,821,892 | 4/1989 | Randall | 211/90 |
| 4,871,136 | 10/1989 | Bessinger | 108/108 X |

FOREIGN PATENT DOCUMENTS 7333787 3/1990 Australia .

*Primary Examiner*—J. Franklin Foss

*Attorney, Agent, or Firm*—James Creighton Wray

[57] ABSTRACT

A shelf bracket having an open mouth in the form of a U-shaped member which is adapted to be connected to a surface and extend outwardly therefrom, the lower flange of the bracket extending beneath a shelf, when the shelf is positioned and having a brace which extends.

6 Claims, 1 Drawing Sheet

SHELF BRACKET

BACKGROUND OF THE INVENTION

This invention relates to a shelf bracket and, in particular, to a shelf bracket which can be of extruded material.

There have been proposed various forms of shelf brackets which are adapted to be connected to a surface and which have a forwardly opening mouth which is adapted to receive the inner edge of a shelf and it is to brackets of this type that the present invention specifically relates.

SUMMARY OF THE INVENTION

It is an object of the present invention to provide a shelf bracket of the type referred to hereinbefore which is simple in construction and which enables effective and rapid location of a shelf after the bracket itself has been located against a surface and which is particularly suitable for use with shelving of uniform thickness.

The invention, in its broadest sense, comprises a shelf bracket having an open mouth in the form of a U-shaped member, the web of the U-shaped member being adapted to be located against a surface, the upper flange being of a length as to overlay at least the inner edge of a shelf and the lower flange extending outwardly for a substantial portion of the width of the shelf and a brace extending downwardly and inwardly from the outer edge of the lower flange, which brace terminates in the plane in which the most inwardly directed portions of the web of the bracket extend.

It may be preferred that a strut or the like be located between the lower flange and the brace adjacent the inner ends thereof.

In order that the invention may be more readily understood, we shall describe one embodiment of bracket made in accordance with the invention in association with the accompanying drawings, in which:

DETAILED DESCRIPTION OF THE DRAWINGS

Figure 1:
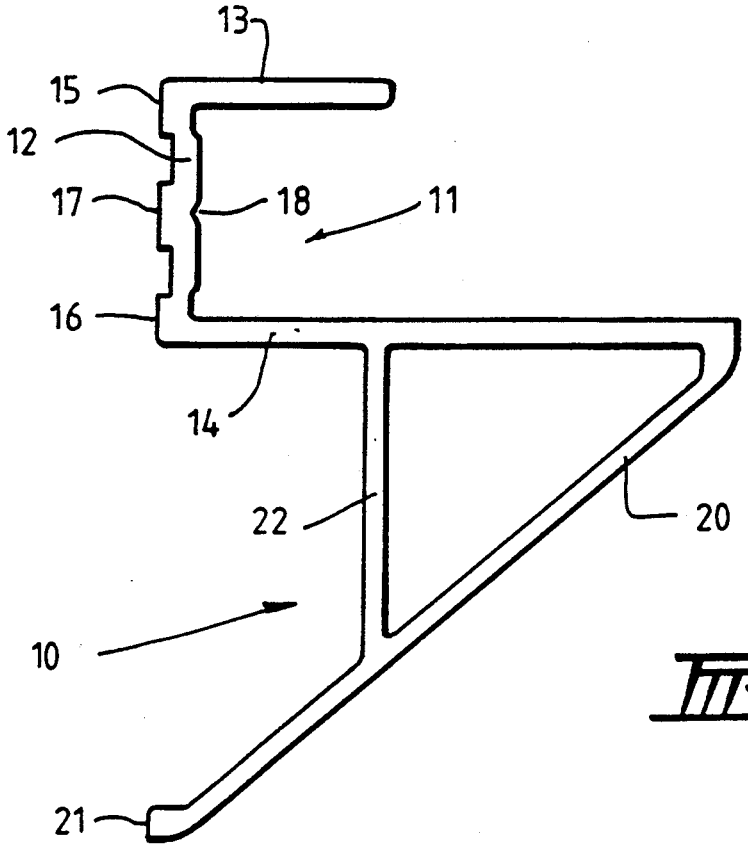
FIG. 1 is an end elevation of the bracket of the invention.
Figure 2:
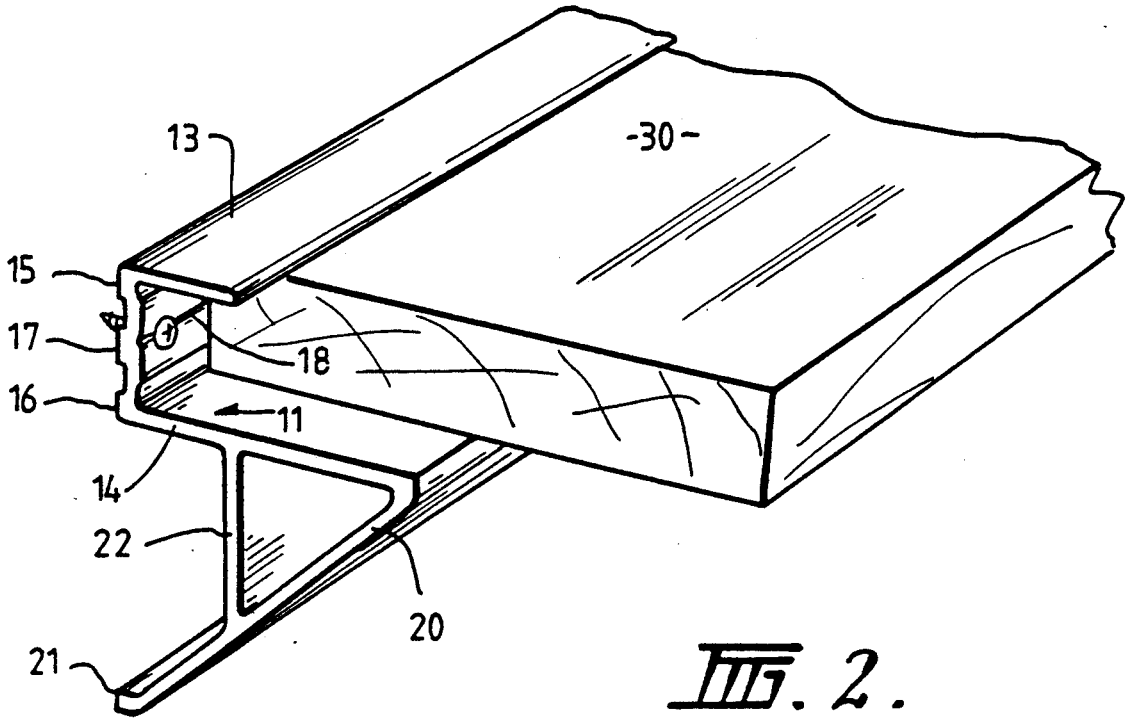
FIG. 2 is a perspective view of the bracket including a shelf.

The bracket 10 may be made of an extruded aluminium alloy having the required strength characteristics for a particular application or, alternatively, could be made from extruded plastics material.

The bracket has a shelf receiving portion which is in the form of an open mouth 11 having a web 12 and two flanges 13.

The web is adapted to be connected to a wall or the like and may either have a flat outer surface adapted to abut the wall or the like or, preferably, an outer surface which has spaced flat portions thereon.

In the particular form illustrated there is a flat portion 15 adjacent the top, a flat portion 16 adjacent the bottom and a flat portion 17 adjacent the centre of the web.

The web may have, on its inner surface, a longitudinal groove 18 which may be central and may be located opposite the central flat portion 17 on the other side, which groove may be adapted to receive fixing screws or the like whereby the bracket can be connected to a surface.

The particular arrangement permits a certain degree of flexibility of the web, 12 and when it is to be attached to the wall, permits certain flexure so that the flat portions 15, 16 and 17 can adopt positions where they are each in contact with the wall, notwithstanding variations in the wall surface.

The height of the web between the inner faces of the two flanges 13, 14 which, together with the web, form the mouth can be such as to closely receive a shelf and, in one particular embodiment, the spacing may be 16 mm.

It will be appreciated that, with present techniques, shelf material which may be of a composite board, can be made to very close tolerances and, thus, the spacing between the flanges and the web can be such as to enable the flanges to co-operate closely with the shelving material of the nominal thickness and the relationship will be effectively constant regardless of the source of the shelving material.

The upper flange 13 is simply adapted to overlay the upper, inner, portion of the shelf.

This can be of the order of 15 mm wide, although the width of this can vary widely.

The lower flange 14 provides a table on which the shelf material will rest and may, if required, be provided, at its outer edge, with a longitudinal raised portion which can co-operate with the material of the shelf and which acts to prevent ready removal of this material from the bracket. The illustrated embodiment does not have such a raised portion.

From the free end of this lower flange there is an inwardly and downwardly returning brace 20, the inner end 21 of which terminates in the same plane as the plane of the innermost portion of the web so that, when the web is in close proximity to a surface, so the free end of this brace will also be in close proximity.

In order to stiffen the assembly somewhat, I may provide a strut 22 which is located between the lower flange 14 and the brace 20 and may be located approximately beneath the free outer end of the upper flange.

This strut gives general stiffness to the assembly.

It will be seen that the bracket described is simple, easy to extrude, either in a metal, such as aluminium, or in a load bearing plastics material and needs to be connected to a surface only by screws or the like along the centre of the web 12.

When the bracket is firmly located against the surface, it is only necessary to slide a shelf 30 of the required thickness into the mouth and, because of the close relationship between the mouth and the shelf, the shelf is firmly located and has little tendency to move outwardly.

The weight of the shelf, and certainly the weight of the shelf and its contents, tends to provide a turning force about the junction between the web 12 and the lower flange 14 and, indeed, if required, this may be built up slightly to resist such a force, but the force does ensure that the free end of the brace is in contact with the surface, below the point of contact of the web and, as such, a very stable assembly is achieved.

It will also be seen that the actual bracket of the invention is easy to form by extrusion, uses a minimal quantity of metal (or plastics) and yet can be solid and sturdy.

I claim:

1. A shelf bracket having an open mouth in the form of a U-shaped member, a web of the U-shaped member being adapted to be flexibly located against a surface, a generally horizontal upper flange being of a length as to overlay at least an inner edge of a shelf and a generally horizontal lower flange extending outwardly for a substantial portion of the width of the shelf and a brace extending downwardly and inwardly from an outer edge of the lower flange, which brace terminates in an inner end in the plane in which the most inwardly directed portions of the web of the bracket extend and a strut between the lower flange and the brace spaced away from the surface.

2. A shelf bracket as claimed in claim 1 wherein the web of the U-shaped member has extensions from a rear side thereof which extensions lie in a same plane and wherein portion of the bracket between the extensions is narrower than that at the extensions so that the web has certain flexibility.

3. A shelf bracket as claimed in claim 2 wherein the extensions of the web are along each edge of and an extension substantially centrally from the rear side of the web.

4. A shelf bracket as claimed in claim 1 wherein the strut is located between the lower flange and the brace which strut is substantially beneath the termination of the upper flange spaced away from a surface on which the bracket is to be located.

5. A shelf bracket as claimed in claim 1 wherein the web of the U-shaped member is effectively extended downwardly to be joined to the inner end of the brace.

6. A shelf bracket as claimed in claim 3 wherein the web has a substantially central groove therealong on a front side of the web, which groove is adapted to receive fixing means.

* * * * *